US007716860B1

(12) United States Patent
Burris

(10) Patent No.: US 7,716,860 B1
(45) Date of Patent: May 18, 2010

(54) RETRACTABLE BANNER DISPLAY

(76) Inventor: Jeff Burris, 3939 E. Delta Cir., Mesa, AZ (US) 85206

( * ) Notice: Subject to any disclaimer, the term of this patent is extended or adjusted under 35 U.S.C. 154(b) by 554 days.

(21) Appl. No.: 11/466,358

(22) Filed: Aug. 22, 2006

(51) Int. Cl.
*G09F 11/18* (2006.01)

(52) U.S. Cl. ..... 40/514; 160/23.1

(58) Field of Classification Search ..... 40/603, 40/604, 514, 515, 517, 116, 385; 248/267; 160/23.1, 24, 325
See application file for complete search history.

(56) References Cited

U.S. PATENT DOCUMENTS

| | | | | |
|---|---|---|---|---|
| 811,874 | A | 2/1906 | Ruff | |
| 889,925 | A | 6/1908 | Hampton et al. | |
| 1,101,324 | A | 6/1914 | Parker | |
| 1,105,486 | A | 7/1914 | Caron | |
| 1,120,494 | A * | 12/1914 | Hoenisch | 248/267 |
| 1,218,774 | A | 3/1917 | Hoover | |
| 1,836,727 | A | 12/1931 | Rathe | |
| 2,049,471 | A | 8/1936 | Rathe | |
| 2,261,044 | A | 10/1941 | Winter | |
| 2,500,706 | A | 3/1950 | Frank | |
| 2,506,209 | A * | 5/1950 | Glass | 40/514 |
| 2,633,322 | A | 3/1953 | Barr | |
| 4,538,785 | A | 9/1985 | Damsgaard | |
| 4,936,728 | A | 6/1990 | Sainsbury, Jr. | |
| 5,505,418 | A | 4/1996 | Corcoran | |
| 5,857,653 | A | 1/1999 | Dujlovich | |
| 5,983,545 | A * | 11/1999 | Marco | 40/610 |
| 6,991,019 | B2 * | 1/2006 | Chang | 160/24 |
| 7,135,754 | B2 * | 11/2006 | Sano et al. | 257/528 |
| 7,337,567 | B2 * | 3/2008 | Fritsche et al. | 40/603 |
| 2005/0081413 | A1 * | 4/2005 | Ko | 40/514 |

* cited by examiner

*Primary Examiner*—Joanne Silbermann
(74) *Attorney, Agent, or Firm*—Booth Udall, PLC

(57) ABSTRACT

A retractable banner display includes an easily replaceable banner core. Housing for the banner core includes an end cap with a reentrant opening on its top edge that receives and retains an end peg of the banner core. The end peg has a height greater than its width so that its movement is restricted within the reentrant opening. A retention member, such as a notch, may be included to hold the core within the reentrant opening when the banner is pulled to its extended position. A plurality of replacement banner cores may be included with a display assembly. The banner core may be configured to lock in a first orientation and unlock in a second orientation to assist in loading the core into the housing and assist in maintaining tension in the core. An adapter may be used to adjust the display angle of the banner.

21 Claims, 3 Drawing Sheets

RETRACTABLE BANNER DISPLAY

BACKGROUND

1. Technical Field

Aspects of this document relate generally to signs used in advertising and other communication.

2. Background Art

The use of signs is found in almost every commercial or business setting. Choice of sign materials and structure is often determined by whether a sign will be permanent or temporary and to what surface it will be mounted. For temporary signs, a wide variety of sign designs attempt to balance factors such as size, cost, ease of installation, image quality, and others to meet specific needs. Among these designs are retractable banner displays. Conventional signs utilize a flexible banner displaying graphics and other information that is capable of retracting into a housing.

SUMMARY

Implementations of a temporary sign with a retractable banner are disclosed in this document.

Aspects of this disclosure relate to a retractable banner display assembly that includes an easily replaceable banner core. The banner core includes a roller, end pegs, the end pegs being biased to a rest position with respect to the roller, and a banner wrapped around the core. Housing for the banner core includes end caps to receive and retain the end pegs of the core against tension caused when the banner is drawn from its retracted position to its extended position. At least one of the end pegs includes a height larger than its width so that it may be inserted into a reentrant opening extending from a top edge of an end cap and when inserted its rotation is restricted. The reentrant opening further includes a locking element such as a notch or locking latch to retain the end peg within the reentrant opening. A banner support is included and configured to couple to the distal end of the banner when the banner is moved to its extended position. A plane substantially parallel to the axis of rotation for the core is formed by the top edge of the end cap and a majority of the banner crosses the plane of the top edge when the banner is moved from its retracted to its extended position. The top edge of the end cap may be directed substantially in the pulling direction of the banner.

Specifically, the locking member may include one or more notches of various shapes or a pivoting or otherwise locking bar to engage the end peg and restrict its movement. Housing may be included that encloses and protects at least a portion of the banner core on at least three sides, and implementations are contemplated that include housing along at least a portion of the top edge of the banner core as well. In particular implementations of retractable banner display assemblies, the core tension may be retained in the core by locking the core through reorientation of the core. Specifically, this may be accomplished through the use of at least one bearing and a bearing race within the core cap. In a first orientation the bearings mechanically interfere with rotation of the roller with respect to the end peg. In a second orientation, the bearings, if free to move, do not interfere with rotation of the roller. The assembly may be configured with a plurality of replaceable cores each having a different banner thereon, at least one different banner displaying a different image.

A banner support adapter comprises a knob, a sleeve sized to rotatably mate with a post, and an adapter post. The sleeve is cylindrical in shape and includes a center axis. The adapter post, while not necessarily cylindrical, also includes a center axis. The center axis of the cylindrical sleeve hole and the center axis of the adapter post have an angle between them that allows for adjustment of the angle at which the banner support retains the support pole. The support adapter couples between the banner support and the support pole.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended purposes of a retractable banner display and/or assembly procedures for such a display will become apparent for use with particular implementations from this disclosure. Accordingly, for example, although particular banner, housing, pole, and roller components and materials are disclosed, such materials and implemented components may comprise any shape, size, style, type, model, version, measurement, concentration, material, quantity, and/or the like as is known in the art for such materials and implemented components, consistent with the intended operation of a retractable banner display.

1. Structure

Figure 1:
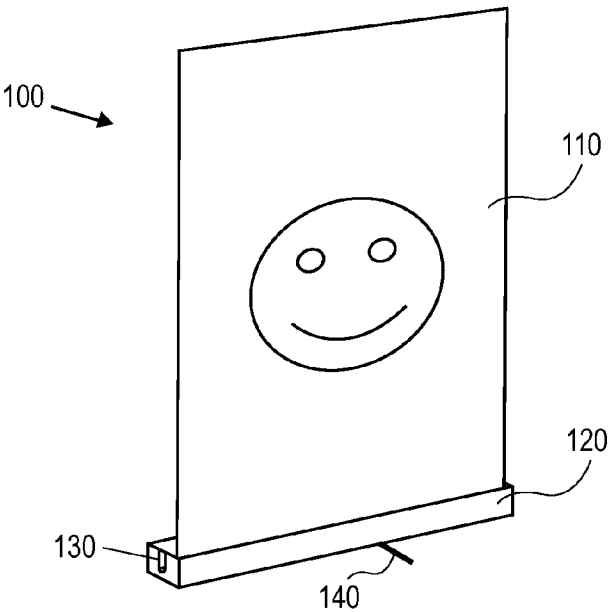
FIG. 1 is a front view of a particular implementation of a retractable banner assembly.
Figure 2:
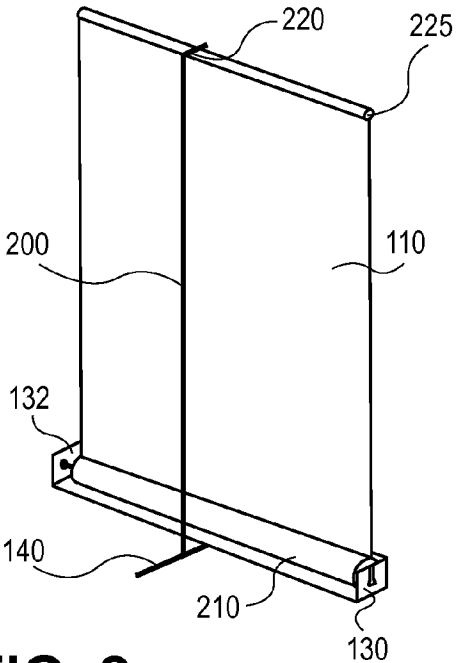
FIG. 2 is a rear view of a particular implementation of a retractable banner assembly with a side of the housing removed.

Referring to FIGS. 1 and 2, a particular implementation of a retractable banner display 100 is illustrated. In this particular implementation, the display 100 includes a banner 110 and a housing 120 with end caps 130 and 132. The banner 110 may be constructed of materials known to those in the art such as, by non-limiting example, fabric, vinyl, plastic, paper, and the like. Within the housing 120 is a core 210 to which the banner 110 is attached. The banner 110 is supported by a pole 200 attached to a foot 140 which is coupled with the housing 120. The pole 200 includes a banner support 220 at its top for holding the banner 110 in an extended position.

Figure 3:
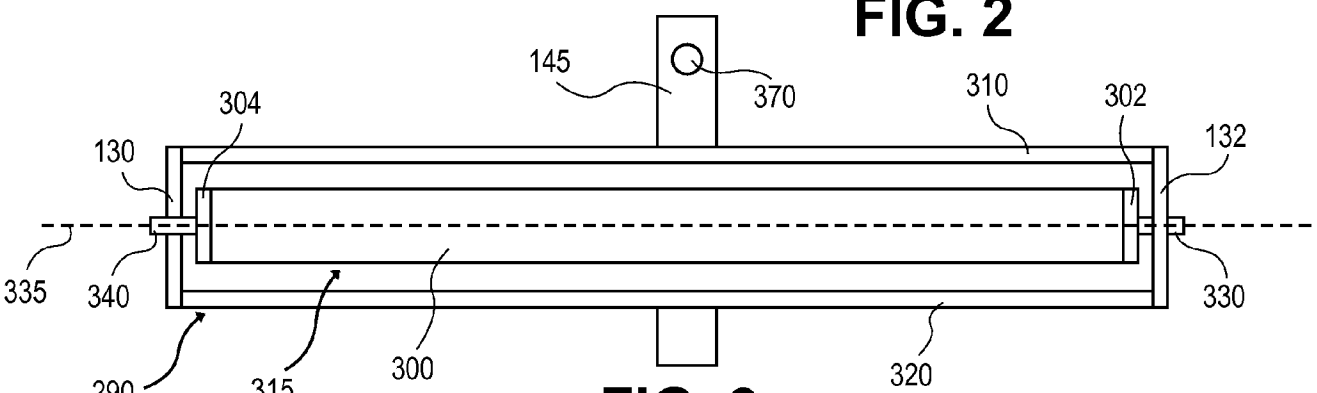
FIG. 3 is a top view of a particular implementation of a retractable banner assembly.

Referring to FIG. 3, a detailed view of a particular implementation of a housing 290 for a retractable banner display is illustrated. The housing 290 illustrated in FIG. 3 includes a foot plate 145 from which a pole post 370 extends, together forming an optional support. The support is coupled to the housing 290 to provide additional support to an erect display such as display 100 shown in FIG. 1. The pole post 370 in this implementation is configured to couple with a pole 200 such as that shown in FIG. 2. The housing 290 comprises sides 310 and 320 that serve to cover portions of the core 315 on three sides. The core 315 includes a roller 300 to which an end of the banner is attached. The banner end is conventionally rolled around the roller 300 and either glued to the roller 300 or clamped inside or to the outside of the roller 300 or core 315. The core 315 includes core cap 302 rotatably supporting a round end peg 330 and core cap 304 rotatably supporting a flat end peg 340, through which the roller 300 is permitted to rotate along the roller's axis of rotation 335. The core 315 contains an internal mechanism to bias the flat end peg 340 to a rest position. The "rest position" describes the condition when the flat end peg 340 is not under the influence of tension from the core 315. The end pegs 340 and 330 couple with the housing at the end caps 130 and 132. The core 315 may be placed under tension (or biased) by rotating the core 315 with respect to the flat end peg 340. Much like a tensioned window shade, pulling the banner from the roller 300 while restricting the rotation of the flat end peg 340 causes the banner to extend and build tension in the banner that tends to draw the banner in toward the roller 300 and re-wind the banner around the roller 300. Unlike a window shade, however, the core 315 of particular implementations of the retractable banner display disclosed herein do not lock to hold the tension experienced by the core 315.

In a particular implementation of a retractable banner display, the core 315 is configured so that in one orientation, the core 315 coupled to a banner acts like a window shade that locks to hold the tension and in another orientation the core cannot lock and therefore remains under constant tension until the tension is released. An example of a core 315 that is capable of locking in a first orientation to hold tension and being incapable of locking in a second orientation so that the core remains under constant tension until the tension is released includes window shade rollers available from Draper, Inc., Spiceland, Ind. that are configured to include bearings and a bearing race within the core cap. The bearings are configured to roll to one end of the bearing race to lock the core and the roller position with respect to the flat end peg to hold the tension in one orientation, and configured to roll to another end of the bearing race to release the core in a second orientation and allow release of the core tension.

The end caps 130 and 132 may be of different shapes, including, by non-limiting example, square, round, triangular, or irregularly dimensioned. While the particular implementation shown in FIGS. 1-3 illustrates end caps 130 that are flat and square, many other end cap shapes may be included in other implementations including those that are not flat, are rounded, or include other three dimensional decorative or functional features such as logos or knobs.

Each of the end caps 130 and 132 includes a top edge 410. The top edge 410 of an end cap 130 or 132 is the edge or portion of the edge that is in the general direction of the supported, extended banner for a retractable banner display. For example, in the implementations shown in FIGS. 1 and 2, the top edge 410 is the edge of the end cap 130 and 132 facing the direction in which the pole 200 and banner 110 extend. The top edges 410 of the end caps 130 and 132 may be positioned at a level where the end of the core 315 is visible. The top edges 410 of the end caps 130 and 132 define a plane substantially parallel to the axis of rotation 335 of the roller 300. This plane conforms to the particular shape of the top edges 410 of the end caps 130 and 132, which, depending on the shape of the top edges 410 of the end caps 130 and 132, could be curved, straight, or irregular.

Referring to FIGS. 4*a* to 4*d*, several particular implementations of end cap 130 of the housing 120 are illustrated for the end cap 130 used to support to the flat end peg 340. When the core 315 is biased or under tension, as when the banner 110 is fully extended, maintenance of the bias is accomplished by holding the flat end peg 340 in a fixed position so that it cannot rotate. While holding the flat end peg 340 in the fixed position can be accomplished by fixing the peg 340 in a corresponding rectangular hole in the end cap 130, a rectangular hole renders it difficult for users of the retractable sign display 100 to remove the core 210 to change the banner 110 being displayed.

Conventional retractable banner display systems trap the banner in the housing so that lay users of the display system cannot change the banner and are required to send the display system back to the manufacturer for a different image or are required to use special tools to change the banner core. To allow users of a retractable banner display system to more easily exchange the core 315, FIGS. 4*a* to 4*d* illustrate a variety of implementations of end cap 130 that each includes a reentrant opening 420, 422, 424 or 426 on the top edge 410 of the end cap 130. The reentrant openings 420, 422, 424 and 426 are each wider that the smallest dimension of the rectangular flat end peg 340, but narrower than the largest dimension of the flat end peg 340 to allow the flat end peg 340 to slide in and out but not rotate within the openings 420, 422, 424 and 426. For each example implementation provided, an end view of a flat end peg 340 is included within the reentrant opening 420, 422, 424 and 426 to illustrate how the position of the flat end peg 340 may be fixed with respect to the housing 290 through use of an appropriately configured end cap.

Figure 4B:
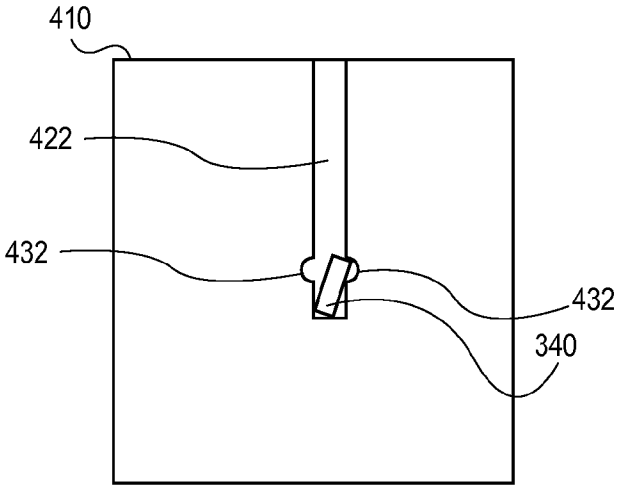
FIG. 4*b* is a front view of an end cap showing a particular implementation of a reentrant opening with an opening for locking a roller end peg including two half circular openings.
Figure 4D:
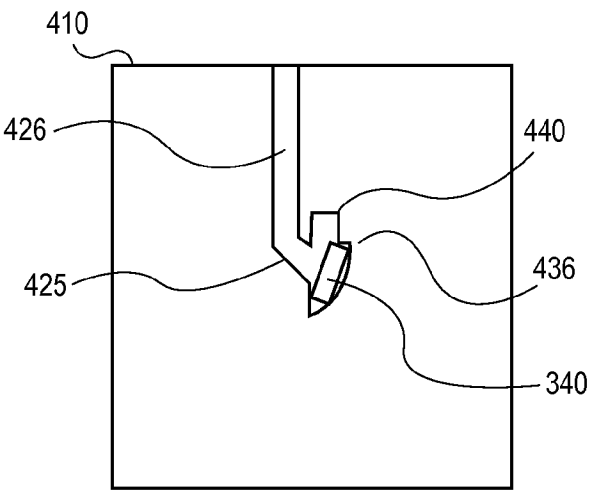
FIG. 4*d* is a front view of an end cap showing a particular implementation of a reentrant opening including a slanted portion with a notch for locking a roller end peg and a recess for retaining the roller end peg when the retractable banner display is overturned.
Figure 4A:
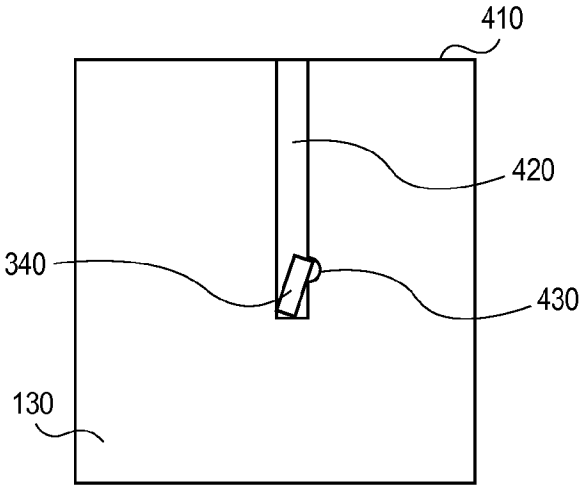
FIG. 4*a* is a front view of an end cap showing a particular implementation of a reentrant opening with a half circular opening for locking a roller end peg.

FIGS. 4*a* and 4*b* show reentrant openings 420 and 422, respectively, extending inward from the top edge 410 with a notch 430 and 432, respectively, recessed from a side of the reentrant openings 420 and 422. For FIG. 4*a*, when the core is tensioned so that the flat end peg 340 is biased clockwise, the flat end peg 340 locks itself into the notch 430 and prevents the core from inadvertently falling out of the reentrant opening 420 even when the housing is turned upside down. In use, as explained more fully below, the core 315 is intended to be loaded into the housing and end cap 130 with the core 315 pretensioned. For FIG. 4*b*, the flat end peg 340 will lock itself into one of the notches 432 regardless of which direction the flat end peg 340 is biased.

Note that the reentrant openings 420, 422, 424 and 426 are positioned substantially in the center of the end caps 130. Although this is not a requirement, configuring the end cap 130 so that the axis of rotation 335 is substantially in the center of the end cap 130 will allow manufacture of the respective housing to be minimized as much as possible to fit the size of the core 315 with the banner rolled on it.

Additionally, because a banner attached to the core 315 is under constant tension when attached to a support pole in the extended position, and the flat end peg 340 is kept biased into the notch 430, 432, 434 and 436, particular implementations of a retractable banner display can be used with the banner extended horizontally, vertically, in a diagonal orientation, or even downward with the housing 290 above the banner. In these various orientations, the top edge 410 of the end cap 130 remains as defined previously.

Figure 4C:
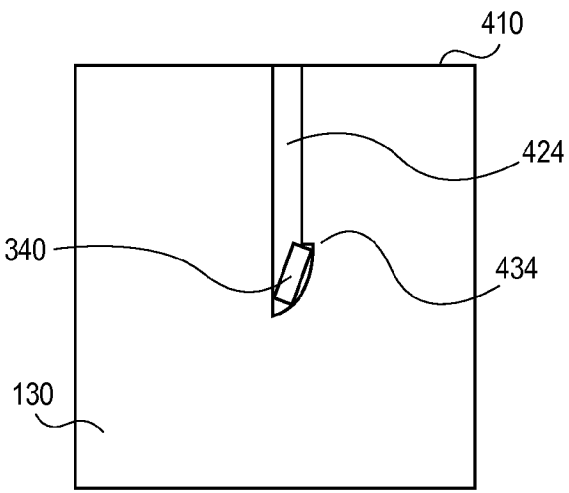
FIG. 4*c* is a front view of an end cap showing a particular implementation of a reentrant opening with an opening for locking a roller end peg including a notch with a curved edge.

Referring to FIGS. 4*c* and 4*d*, other particular implementations of an end cap 130 with a reentrant opening 424 and 426, respectively, and respective notches 434 and 436 are illustrated. The notch 434 or 436 may extend on either side of the reentrant opening 424 or 426. The shape of the notch is not crucial provided it allows the flat end peg 340 to engage within the reentrant opening. For example, as shown in FIG. 4*c*, the notch 434 may be a rounded section jutting off the side of the reentrant opening 424. Alternatively, as shown in FIG. 4*d*, the reentrant opening 426 may extend inward from the top edge 410 and angle 425 toward the center of the end cap 130. The example in FIG. 4*d* also includes a second reentrant opening 440 extending toward the top edge 410 from within the first reentrant opening 426. This second reentrant opening 440 provides an additional safety to catch the flat end peg 340 if the housing is turned upside down when the flat end peg 340 is not under bias (i.e. the core 315 is not under tension or the core 315 tension has been locked).

As an alternative to including a notch, such as the notch examples shown in FIGS. 4*a* to 4*d*, or in addition to the notch, a locking latch assembly may be coupled to the end cap that pivotally, or otherwise, engages the flat end peg 340 or releases it when removed at the option of the user. With a locking latch in the form of a pivoting arm or retention bar to engage the flat end peg 340, for example, a notch may not be needed at all or at least its function would be additionally reinforced.

Figure 5:
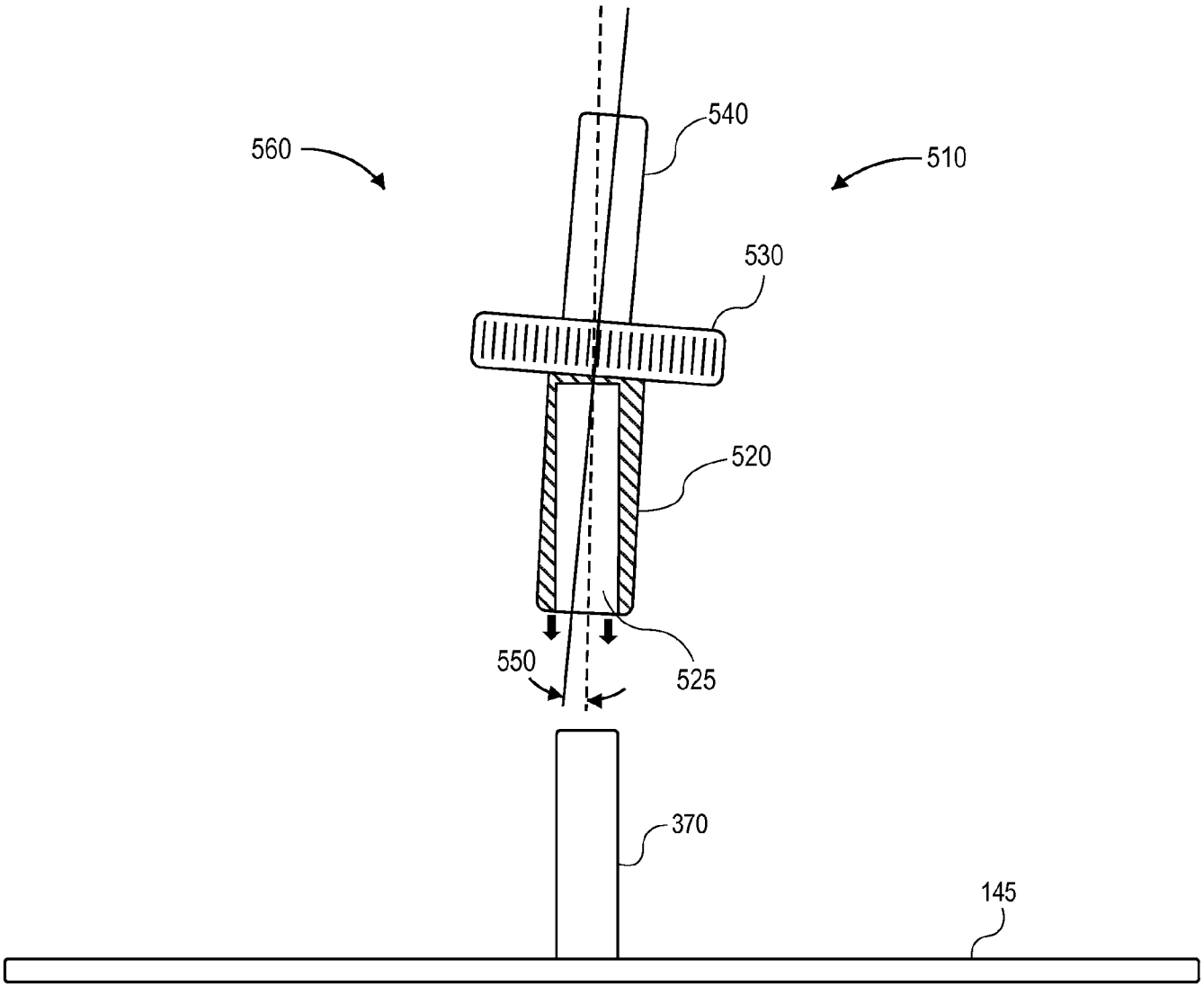
FIG. 5 is a side view of a particular implementation of a banner support post adapter.

Referring to FIG. 5, a banner support 560 is illustrated. The support 560 of this particular implementation includes an adapter 510 that may be coupled between the pole post 370 and a support pole, such as pole 200 of FIG. 2. The adapter 510 of this implementation includes an adapter pole post 540, a knob 530 and a sleeve 520 with a hole 525 extending lengthwise into the sleeve 520. The drawing in FIG. 5 shows the sleeve 520 in cross-section to show the hole extending into the sleeve. The adapter 510 is formed so that the adapter pole post 540 is at an angle 550 with respect to vertical when the sleeve 520 is placed on a vertical pole post 370. Although the angle 550 shown in FIG. 5 is exaggerated to emphasize the angle, it provides an example of the intended angle 550. The effect of angle 550 may be created in many ways including, but not limited to, forming the hole 525 within the sleeve 520 that is at an angle with respect to the sleeve 520 sides, forming a hole 525 that is at an angle with respect to the adapter pole post 540, forming an adapter pole post 540 that is at an angle with respect to the sleeve 520 and hole 525, and combinations thereof.

To maintain stability in a retractable banner display as the banner gets taller, tilting the banner slightly backward to a different support angle is desirable. In particular implementations of a retractable banner display, like that shown in FIG. 3, because the banner core may be easily replaced by the end user, and may be replaced by a banner having a different length than was originally installed into the housing 290, the ability to adjust the angle at which the banner is held erect is also desirable. Additionally, a retractable banner display that can more readily adapt to different floor types and environments would make the display more rugged and robust. In particular implementations of a retractable banner display, the angle 550 of the adapter 560 is configured between 0 and 7 degrees from vertical. The particular angle selected for a particular implementation depends on several factors including, but not limited to, pole strength and size, banner weight and height, and environmental conditions. For example, for a ⅞ inch outer diameter aluminum pole, with an 8 foot high banner zero degrees adjustment is needed. When a ⅝ inch outer diameter aluminum pole, however, approximately 2-3 degrees is more appropriate. For a 12 foot high banner using a ⅞ inch outer diameter aluminum pole, 2-3 degrees is needed. Different angles are needed for different conditions and implementations.

In practice, with the angle 550 established in the rotatable adapter, an end user need only turn the adapter 560 until the adapter pole post 540 is at an appropriate angle relative to vertical at which to hold the banner in its extended position regardless of the implementation or condition. If the banner display is at an unstable angle for any reason, the end user may simply turn the knob 530 to change the angle at which the banner is held by the pole extending from the adapter pole post 540.

2. How to Use

To load a core into housing for a particular implementation of a retractable banner display that includes a core 315 and housing 290 (like that in FIG. 3), a banner is coupled at a first end to the core 315 and rolled around the roller 300. The banner may be coupled to the core 315 before the core caps 302 and 304 are attached or after depending upon the method of coupling. Particular core implementations include a slit along the top of the core and a retention bar within the core that allow a banner with a loop at its first end to have the loop slid over the retention bar within the core so that the banner extends through the slit along the top of the core. Once the core caps 302 and 304 are coupled to the ends of the core 315 in this implementation, the banner is retained on the core 315 and thereafter rolled around the core 315.

With the banner rolled around the core 315, the core 315 is then oriented in an orientation that causes the core 315 to hold the tension it receives, and the flat end post 340 is pretensioned in relation to the rest of the core 315 to establish an initial tension for the core 315. It has been found that winding the flat end post 340 between 5 to 10 turns is an effective amount of tension for the core in this implementation, though this is not required and greater or fewer turns is contemplated for other implementations. A wind-up device conventionally used to pretension window shade cores is known in the art and distributed by Draper, Inc., Spiceland, Ind., a maker of cores appropriate for this implementation. Alternatively, hand winding may be used, but is more difficult.

Once the core 315 has been locked to hold the core tension, it may be reoriented and still maintains the lock and core tension until the flat end peg 340 is twisted to release the lock. With the core 315 locked to hold the tension, the core 315 is reoriented approximately 180 degrees and the core 315 with the banner wound around it is loaded into the housing by inserting the round end peg 330 into an opening in the housing end cap 132 and sliding the flat end peg 340 into the reentrant opening in the housing end cap 130. The lock may then be released by slightly turning the roller 290 in relation to the flat end peg 340 which causes the tension to be released.

The banner wrapped around the core 315 is adapted so that its second end includes a support 225 (FIG. 2) extending the width of the banner. This support not only helps to keep the banner taut when supported by the support pole 200 and support hook 220, it also acts to prevent the second end of the banner from retracting too far into the housing 290 (FIG. 3) by interfering with the housing 290. When the core lock is released, the banner support 225 end contacts the housing 290, causing the core tension to hold with the flat end peg 340 biased toward the notch (examples in FIGS. 4*a*-4*d*) to lock the core 315 into the housing 290. In this configuration, the banner may be pulled from the housing 290 and it will unwind from the core 300 until it is extended for proper display.

In a particular implementation for use, the housing 290 further includes a foot 145 and pole post 370 (like that in FIG. 3) and a support pole 200 (FIG. 2). The support pole 200 is placed over the pole post 370 and the banner 110 is extended to the extent of the support pole 200. The banner support 225 is coupled to the end of the pole 200 to maintain the banner 110 in its extended position. The banner 110 extends from the housing 290 in the general direction of the top end 410 (FIG. 4*a*) of the end cap 130. In particular implementations, the reentrant opening 420 also opens in the general direction that the banner stands when erect. In very specific implementations, the reentrant opening channel extends into the end cap 130 at an angle that is within 10 degrees of the banner when the banner is in its extended position supported by the support pole 200.

For longer banners, an adapter 560 (FIG. 5) may be used between the pole post 370 and the pole 200 to adjust the angle at which the support pole 200 holds the banner 110. To change the angle 550, the user simply turns the knob 530 on the adapter 560 and the pole 200 angle may be changed within a range of angles. As the pole 200 angle changes, the display angle of the banner 110 correspondingly changes. The knob 530 can be turned to ensure the display angle of the banner 110 is in a particular direction, for example, exactly vertical. The use of the adapter 510 is particularly helpful when the banner 110 is tall because support poles 200 for tall banners tend to naturally bend over their length. The adapter 560 allows adjustment of the display angle of the banner 110 to compensate for the bend in a long pole 200. Additional frictional elements may be included within the post, or additional structure may be added, to help in maintaining the adapter position once the proper angle is chosen if determined desirable for a particular implementation.

It will be understood that various implementations described and mentioned herein are not limited to the specific components disclosed, as virtually any components consistent with the intended operation of a method and/or system implementation for a retractable banner display may be utilized. Accordingly, for example, although particular housing, banner, roller, or pole materials may be disclosed, such components may comprise any shape, size, style, type, model, version, class, grade, measurement, concentration, material, weight, quantity, and/or the like consistent with the intended operation of a method and/or system implementation for a retractable banner display may be used.

In places where the description above refers to particular implementations of a retractable banner display, it should be readily apparent that a number of modifications may be made without departing from the spirit thereof and that these implementations may be applied to other types of banner displays that are fixed or movable. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A retractable sign assembly comprising:

a core comprising a roller, an axis of rotation, and an end peg on the axis of rotation, the end peg being biased to a rest position with respect to the roller;

a banner having a first end and a second end, the first end coupled to the core;

a housing comprising at least one end cap having a top edge with a reentrant opening extending inward therefrom, the top edge defining a plane substantially parallel to the axis of rotation of the roller, the reentrant opening configured to receive and retain the end peg of the core; and a banner support coupled to the housing and configured to couple to the second end of the banner when the banner is in an extended position;

wherein a majority of the banner crosses the plane of the top edge when moved from a retracted position to the extended position.

2. The retractable sign assembly of claim 1, wherein the reentrant opening of the end cap further comprises at least one notch receding from a side of the reentrant opening and the end peg has a height greater than its width.

3. The retractable sign assembly of claim 2, wherein the notch comprises at least one semi-circle receding from a side of the reentrant opening.

4. The retractable sign assembly of claim 2, wherein the notch comprises a second reentrant opening within the notch, the second reentrant opening sized to receive at least a portion of the end peg.

5. The retractable sign assembly of claim 1, wherein the housing encloses at least a portion of the core on at least three sides.

6. The retractable sign assembly of claim 1, wherein a locking latch assembly is coupled to the end cap, the locking latch assembly configured to lock the end peg of the roller.

7. The retractable sign assembly of claim 1, wherein the core further comprises a core cap engaging the end peg, the core cap configured to lock the end peg of the core in a biased position.

8. The retractable sign assembly of claim 1, wherein the assembly further comprises a plurality of replaceable cores each having a different image displayed on its respective banner.

9. The retractable sign assembly of claim 1, wherein the banner support comprises a pole post and a post adapter, the post adapter comprising a knob, a sleeve sized to mate with the pole post, and an adapter post, the post adapter being placed between the pole post and the banner support.

10. The retractable sign assembly of claim 9, wherein the sleeve having a cylindrical hole therein, the cylindrical hole having a center axis, and the adapter post being cylindrical and having a center axis, wherein the center axis of the adapter post and the center axis of the cylindrical hole have an angle between them of between approximately 0 degrees and approximately 8 degrees.

11. A retractable sign assembly comprising:

a core comprising a roller, an axis of rotation, and an end peg on the axis of rotation, the end peg being biased to a rest position with respect to the roller;

a banner having a first end, a second end, and a pulling direction, the first end coupled to the core, the pulling direction substantially perpendicular to the axis of rotation of the roller;

a housing comprising at least one end cap having a top edge with a reentrant opening extending inward therefrom, the reentrant opening configured to receive and retain the end peg; and a banner support coupled to the housing and configured to support the banner in an extended position;

wherein the top edge of the end cap faces in the pulling direction of the banner.

12. The retractable sign assembly of claim 11, wherein the reentrant opening of the end cap further comprises at least one notch receding from a side of the reentrant opening and the end peg has a height greater than its width.

13. The retractable sign assembly of claim 12, wherein the notch comprises at least one semi-circle receding from a side of the reentrant opening.

14. The retractable sign assembly of claim 12, wherein the notch comprises a second reentrant opening within the notch, the second reentrant opening sized to receive at least a portion of the end peg.

15. The retractable sign assembly of claim 11, wherein the housing encloses at least a portion of the core on at least three sides.

16. The retractable sign assembly of claim 11, wherein a locking latch assembly is coupled to the end cap, the locking latch assembly configured to lock the end peg of the roller.

17. The retractable sign assembly of claim 11, wherein the core further comprises a core cap engaging the end peg, the core cap configured to lock the end peg of the core in a biased position.

18. The retractable sign assembly of claim 11, wherein the assembly further comprises a plurality of replaceable cores each having a different image displayed on its respective banner.

19. The retractable sign assembly of claim 11, wherein the banner support comprises a pole post and a post adapter, the post adapter comprising a knob, a sleeve sized to mate with the pole post, and an adapter post, the post adapter being placed between the pole post and the banner support.

20. The retractable sign assembly of claim 19, wherein the sleeve having a cylindrical hole therein, the cylindrical hole having a center axis, and the adapter post being cylindrical and having a center axis, wherein the center axis of the adapter post and the center axis of the cylindrical hole have an angle between them of between approximately 0 degrees and approximately 8 degrees.

21. The retractable sign assembly of claim 19, wherein the sleeve having a cylindrical hole therein, the cylindrical hole having a center axis, and the adapter post having a center axis, wherein the center axis of the adapter post and the center axis of the cylindrical hole have an angle between them between greater than 0 degrees and approximately 8 degrees.

* * * * *